US009709340B2

(12) United States Patent
Furumura et al.

(10) Patent No.: US 9,709,340 B2
(45) Date of Patent: Jul. 18, 2017

(54) FLUID HEAT EXCHANGING APPARATUS

(71) Applicant: PHILTECH Inc., Tokyo (JP)

(72) Inventors: Yuji Furumura, Kanagawa (JP); Naomi Mura, Tokyo (JP); Shinji Nishihara, Tokyo (JP); Noriyoshi Shimizu, Tokyo (JP)

(73) Assignee: PHILTECH Inc., Tokyo (JP)

( * ) Notice: Subject to any disclaimer, the term of this patent is extended or adjusted under 35 U.S.C. 154(b) by 330 days.

(21) Appl. No.: 14/538,326

(22) Filed: Nov. 11, 2014

(65) Prior Publication Data

US 2015/0136370 A1 May 21, 2015

(30) Foreign Application Priority Data

Nov. 15, 2013 (JP) ..... 2013-237211

(51) Int. Cl.

| | |
|---|---|
| ***F28D 7/02*** | (2006.01) |
| ***F28F 3/12*** | (2006.01) |
| ***F28F 13/06*** | (2006.01) |
| ***F28F 21/02*** | (2006.01) |
| ***F28F 21/04*** | (2006.01) |
| ***F28F 21/08*** | (2006.01) |

(52) U.S. Cl.

CPC ..... *F28F 3/12* (2013.01); *F28F 13/06* (2013.01); *F28F 21/02* (2013.01); *F28F 21/04* (2013.01); *F28F 21/083* (2013.01)

(58) Field of Classification Search

CPC .... F28F 3/12; F28F 13/06; F28F 21/02; F28F 21/04; F28F 21/083

USPC ..... 165/164, 166, 167, 165

See application file for complete search history.

(56) References Cited

U.S. PATENT DOCUMENTS

| | | | | |
|---|---|---|---|---|
| 97,865 | A * | 12/1869 | Bourne | F24H 1/38 122/215 |
| 1,828,477 | A * | 10/1931 | Seligman | F28D 9/0075 165/164 |
| 5,832,994 | A * | 11/1998 | Nomura | F28D 7/005 165/144 |
| 7,832,543 | B2 * | 11/2010 | Mustalahti | B66B 21/12 198/324 |
| 8,028,664 | B2 * | 10/2011 | Kim | A21B 3/04 122/481 |
| 8,724,978 | B2 * | 5/2014 | Furumura | F22B 1/28 392/484 |
| 2008/0173435 | A1 | 7/2008 | Schubert et al. | |

(Continued)

FOREIGN PATENT DOCUMENTS

| | | | |
|---|---|---|---|
| DE | 661278 | A | 5/1938 |
| DE | 102006013503 | A1 | 1/2008 |
| JP | 2006329439 | A | 7/2006 |

(Continued)

*Primary Examiner* — Justin Jonaitis

(74) *Attorney, Agent, or Firm* — BainwoodHuang

(57) ABSTRACT

In a small-sized fluid heat exchanging apparatus that heats or cools a huge amount of gas or liquid, a structure makes fluid having a high flow speed impinge perpendicularly against a wall. A flow passage is divided into a high-speed flow passage and a low-speed flow passage, and the high-speed flow passage and the low-speed flow passage are arranged so as to intersect perpendicularly with each other, according to guidelines for the shape of the flow passage. A flow passage designed according to the guidelines provides highly-efficient heat exchange.

11 Claims, 14 Drawing Sheets

(56) References Cited

U.S. PATENT DOCUMENTS

| | | | |
|---|---|---|---|
| 2009/0104488 | A1 | 4/2009 | Gruss et al. |
| 2013/0302021 | A1 | 11/2013 | Furumura et al. |

FOREIGN PATENT DOCUMENTS

| | | | |
|---|---|---|---|
| JP | 2009239043 | A | 10/2009 |
| JP | 2010001541 | | 1/2010 |
| JP | 2010519502 | A | 6/2010 |
| JP | 2011001591 | | 1/2011 |
| KR | 1020070053336 | A | 4/2007 |
| KR | 1020110002920 | A | 1/2011 |
| WO | 2006030526 | A1 | 3/2006 |

* cited by examiner

| | Parameter | | | | | | | | |
|---|---|---|---|---|---|---|---|---|---|
| | First Flow Passage (Tub) | | | Second Flow Passage (Channel) | | | | | Base Shape |
| | WW | DD | St = WW * DD | W | D | L | P | Sc = W * D | |
| Example 1 | 4mm | 5mm | 20mm² | 1mm | 2mm | 5mm | 10mm | 2mm² | Planar |
| Example 2 | 3mm | 3mm | 9mm² | 3mm | 1mm | 4mm | 15mm | 3mm² | Cylindrical |

FIG. 9

FLUID HEAT EXCHANGING APPARATUS

BACKGROUND

The present invention relates to a heat exchanging apparatus for heating or cooling fluid instantaneously.

Heat exchanging apparatuses include an apparatus that heats gas, for example. A commonly-used structure thereof is such a structure that gas is heated by making the gas flow through a heated pipe. An alternative structure is such a structure that heated fluid is caused to flow in a pipe having fins, and gas is heated by making the gas flow between the fins.

These structures are used to heat not only gas but also liquid or to generate water vapor. An apparatus for not heating gas but cooling gas generally has a similar structure.

This structure is common and conventional, but the apparatus needs to be large in volume. The reason is that the efficiency of heat exchange between the pipe and the fluid flowing through the pipe is low.

A structure to improve the efficiency of heat exchange in this common structure has been suggested. Examples of the inventions are illustrated in FIGS. 1 and 2.

FIG. 1 is a schematic copy of a main diagram of a patent example that realizes a heating structure called impinging jet (Re-Publication of PCT Patent Publication: WO 2006/030526). Gas that has passed through a pipe impinges against a heated hollow disk and exchanges heat with the disk. A lamp heater for heating is not shown.

FIGS. 2 through 5 are diagrams of an apparatus where a flow passage for performing heat exchange efficiently by gas impinging against a base is disposed on a surface of a base, thereby generating heated gas (FIG. 5 of Patent Literature 2: Japanese Patent Application No. 2008-162332 "FILM FORMING METHOD AND FILM FORMING APPARATUS). The structure of the heat exchanger is explained below by citing the description from the patent literature 2. The following is the citation: "This embodiment has a solid flat-plate-like carbon central plate 24 formed of carbon (including graphite, isotropic carbon or the like, for example) and a pair of left and right solid flat-plate-like carbon side plates 25, 26 made of carbon and attached and fixed to left and right both side faces of the carbon central plate 24. (Partially omitted.) FIG. 5A is a front view of one side face (for example, a left side face) of the carbon central plate 24 having a horizontal width of 240 mm and a height of 30 mm, FIG. 5B is a cross-sectional view taken along line B-B in FIG. 5A, FIG. 5C is a cross-sectional view taken along line C-C in FIG. 5A, and FIG. 5D is a cross-sectional view taken along line D-D in FIG. 5A, where a plurality of pair of left and right 7 mm-wide grooves 27, 27, . . . , 28, 28, . . . shown in FIGS. 6 through 8 and first and second 1 mm-deep lower gas jetting longitudinal holes 31, 32 are formed by the carbon central plate 24 and the pair of left and right carbon side plates 25, 26. The plurality of pair of left and right grooves 27, 27 . . . , 28, 28 . . . are each so formed as to make first and second introduced gas flow individually therethrough longitudinally in FIGS. 3 and 4, and the pair of left and right grooves 27, 28 are not jointed together leftward or rightward (laterally).

The reference numeral 38 in FIG. 5A denotes a plurality of 1 mm-wide longitudinal communicating grooves forming communication longitudinally in FIG. 5A for each of the pairs of left and right grooves 27, 28, and the reference numeral 39 denotes an insertion hole in which a heating lamp 40 is inserted. The heating lamp 40 is a lamp of 200 V and 2.2 kW, for example, and is a clean heat source connected to a power line 19 and fed with required power to generate heat at a high temperature. For this reason, the heat generation of the heating lamp 40 causes the carbon central plate 24 and the pair of left and right carbon side plates 25, 26 to be heated to high temperatures, and first and second upper gas introducing longitudinal holes 29, 30, the pair of left and right grooves 27, 27 . . . , 28, 28 . . . , and the first and second lower gas jetting longitudinal holes 31, 32, namely, a pair of left and right first and second gas passages, which are formed by these plates 24, 25, 26, are heated.

At this time, nitrogen gas is introduced into the pair of left and right first and second upper gas introducing longitudinal holes 29, 30 of the heating apparatus from the first and second gas introducing pipes 18*a*, 18*b*. The nitrogen gas is heated to a required high temperature (for example, 650° C.) until the nitrogen gas reaches first and second jetting holes 35, 36 via the pair of left and right grooves 27, 27 . . . , 28, 28, . . . , and the first and second lower gas jetting longitudinal holes in this order. Production of high-temperature gas was succeeded by the small-sized heating apparatus."

FIGS. 2 through 5 have been explained above by citing the description from Patent Literature 2.

For example, according to calculation, the speed of gas passing through a pipe having a 1-$cm^2$ cross-section at a flow rate of 100 SLM (standard liter per minute) is 16 m/second. Assuming that the gas smoothly flows through the pipe, the time required for the gas to pass through an apparatus having such a flow passage cross-section is 0.01 seconds or less. That is, the gas is heated instantaneously up to the temperature of heated carbon. The structure shown in FIG. 2 is a structure which makes making instantaneous heat exchange possible.

An apparatus that heats gas instantaneously and jet out the high temperature gas is applied not only to heating or drying but also to a process for heating and baking various materials (metal, a dielectric material, or the like) applied over a substrate. These apparatuses are also useful for heating liquid, such as water.

An apparatus that cools gas instantaneously is applied to cooling of water vapor from a turbine, cooling of a coolant of a cooling and heating machine, cooling of exhaust heat of a boiler, or the like. The application to cooling of a coolant is promising in geothermal generation that has recently attracted attention.

SUMMARY OF THE INVENTION

The present invention relates to an apparatus that performs efficient instantaneous heating or instantaneous cooling of fluid, such as liquid or gas.

The physics of a heat exchanger structure of the present invention lies in increasing the flow speed of gas in a flow passage of narrow longitudinal grooves, thereby making the fluid impinge against walls of flow passages of horizontal grooves perpendicularly at high speed to perform heat exchange between the walls of the flow passages of the horizontal grooves and the gas efficiently. This physics holds not only for gas but also for fluid, including liquid.

The structure shown in FIG. 2 that realizes the physics of making fluid impinge against the wall of the flow passage at high speed is hereinbelow referred to as the "prior art structure".

In order to increase the flow speed of the fluid in the flow passage of the longitudinal groove to make the fluid impinge powerfully against the wall of the flow passage of the horizontal groove thereby improving the efficiency of heat exchange, it is necessary to design the flow passage of the longitudinal groove according to the horizontal groove.

In this regard, if it is easy to perform cutting to form a flow passage composed of a groove having a small cross-section, the cutting cost is not high. In the patent literature 2, an example is shown in which the width of the flow passage of the longitudinal groove is 1 mm and the width of the flow passage of the horizontal groove is 7 mm. These dimensions are clearly effective to achieve the object of high-speed impingement, but this is merely one example.

There are many combinations of effective widths of the flow passage of the longitudinal groove and the flow passage of the horizontal groove. If the depth of the flow passage of the groove is 1 mm to 3 mm, the flow passage of the longitudinal groove can be easily machined by an end mill. If a material that cannot be easily cut is used, the flow passage of the longitudinal groove cannot be easily machined, the cutting work adversely affects the manufacturing cost.

Therefore, the design of the prior art structure satisfying easy machining is required. Then, the design guidelines for the dimensions of the horizontal flow passage need to be established.

FIRST EMBODIMENT

One or more embodiments of the present invention are heat exchanging apparatuses in which a base in which a flow passage for fluid is formed is jointed to a sealing plate sealing the flow passage to form an airtight flow passage, the flow passage including first flow passages opened outside in a surface of the base, elongated in one direction, and formed in a plurality of stages in one direction of the base at required intervals, and a plurality of second flow passages perpendicular to the first flow passages and connecting adjacent first flow passages of the first flow passages in a communicating manner, in a structure of the heat exchanging apparatus where a flow passage is formed such that fluid introduced into a first flow passage of the first flow passages located at one end passes through the first flow passage located at one end and the second flow passages and reach a first flow passage of the first flow passages located at the other end, and fluid introduced into the flow passage impinges perpendicularly against walls of the first flow passages to perform heat exchange, and the fluid is discharged from a fluid outlet hole located at the other end of the flow passage, wherein a flow speed in the second flow passages is higher than a flow speed in the first flow passages.

SECOND EMBODIMENT

One or more embodiments of the present invention are the heat exchanging apparatuses according to the first embodiment, wherein two or more of the following conditions are satisfied: a cross-sectional area St of the first flow passages is twice as large as a cross-sectional area Sc of the second flow passages; a length L of the second flow passages is longer than a width WW of the first flow passages; and an arrangement pitch of the second flow passages is twice as large as a width of the second flow passages.

THIRD EMBODIMENT

One or more embodiments of the present invention are the heat exchanging apparatuses according to the first or second embodiment, wherein the base in which the flow passage is formed is either one of a plate and a tube having a cylindrical, columnar, or prismatic shape.

FOURTH EMBODIMENT

One or more embodiments of the present invention are the heat exchanging apparatuses according to any one of the first to third embodiments, wherein the base and the sealing plate are composed of at least one of metal, graphite, ceramic, plastic, and a composite material.

FIFTH EMBODIMENT

One or more embodiments of the present invention are the heat exchanging apparatuses according to the fourth embodiment, wherein the composite material is a composite material of two or more of metal, metal fiber, carbon nanotube, graphene, carbon fiber, and plastic.

SIXTH EMBODIMENT

One or more embodiments of the present invention are the heat exchanging apparatuses according to any one of the first to fifth embodiments, wherein the structure is manufactured by machining the base by means of a die to shape the first and second flow passages, and joining the sealing plate to the base.

SEVENTH EMBODIMENT

One or more embodiments of the present invention are the heat exchanging apparatuses according to any one of the first to sixth embodiments, wherein a material surface of the heat exchanging apparatus is lined with resin, coated, plated, or protected with an oxide film.

EIGHTH EMBODIMENT

One or more embodiments of the present invention are the heat exchanging apparatuses according to any one of the first to seventh embodiments, wherein the fluid is gas or liquid.

NINTH EMBODIMENT

One or more embodiments of the present invention are the heat exchanging apparatuses according to any one of the first to eighth embodiments, wherein the fluid is steam having a temperature exceeding 100° C.

TENTH EMBODIMENT

One or more embodiments of the present invention are the heat exchanging apparatuses according to any one of the first to ninth embodiments, wherein the heat exchanging apparatus heats the fluid by being mounted with a heater or being placed in a heated high-temperature medium.

ELEVENTH EMBODIMENT

One or more embodiments of the present invention are the heat exchanging apparatuses according to any one of the first to ninth embodiments, wherein the heat exchanging apparatus cools the fluid by being brought into contact with a low-temperature medium or being placed in a low-temperature medium.

TWELFTH EMBODIMENT

One or more embodiments of the present invention are heat exchanging apparatuses, wherein two heat exchanging apparatuses according to any one of the first to eleventh embodiments are joined together, and first fluid and second fluid are caused to flow through the two heat exchanging apparatuses, respectively.

THIRTEENTH EMBODIMENT

One or more embodiments of the present invention are apparatuses which bring high-temperature steam generated by the heat exchanging apparatus according to any one of the first to twelfth embodiments into contact with organic matter or gas containing organic matter.

According to one or more embodiments of the present invention, the design guidelines for the structure to make the fluid impinge perpendicularly against the wall of the flow passage are applicable regardless of the size or shape of the heat exchanging apparatus.

Since the design guidelines are merely guidelines, Sc, St, L, WW, P and W can be arbitrarily set within an acceptable machining cost range as long as high-flow-speed impingement occurs. When the flow rate is desired to be set large, it is preferred that the cross-section of the flow passage be enlarged within a reasonable machining cost range according to the design guidelines.

According to one or more embodiments of the present invention, the material can be selected according to a use temperature, a heat medium environment, or the cutting work cost of the base.

As the material, a surface-treated metal, a resin-lined metal, a metal with a surface oxide film, or a plastic composite material having an increased thermal conductivity can be used. From these materials, a material preventing corrosion or wear due to contact with the fluid or the heat medium can be selected.

Therefore, it is possible to heat or cool such fluid as corrosive chemicals or penetrative toxic gas.

When an easily-deformable material is selected as the material, the flow passage can be formed by die pressing. When a metal plate is selected, the metal plate can be joined by welding or an electric welder. A plastic material can be joined with an adhesive. Swaging is an easy method for canning. Since existing processing facilities can be used according to selection of the material, the manufacturing cost for producing the heat exchanging apparatus can be reduced.

According to one or more embodiments of the present invention, gas and liquid can be handled as fluid.

When oxygen is selected as the fluid, heated oxygen can be produced instantaneously. When hydrogen or formic acid is selected as the fluid, high-temperature reducing gas can be produced instantaneously. When an oxide film on a bump surface is reduced, melting of the bump occurs at low temperature in a well-reproducible manner, so that the bump joining process becomes stable.

When air and town gas are selected as the fluid, high-temperature air and fuel can be introduced into a boiler in a mixed manner, so the combustion temperature rises and the combustion efficiency improves, which results in saving the town gas. The heated air improves the combustion efficiency of an internal combustion engine so that such fuel as fuel oil can be saved.

When water is heated into superheated steam of 100° C. or higher, heating or drying can be performed in the absence of oxygen. When ribbed mutton was roasted with superheated steam of 300° C., the strings of the meat became tender.

High-temperature steam can be produced at hand and utilized for drying of dry-cleaning that should avoid oxidation or for instantaneous drying of printing ink.

When material chips having high thermally-insulating properties stored in a container are desired to be heated, it is time-consuming to heat the container because of the high thermally-insulating properties.

In such a case, by introducing heated steam, air, or nitrogen, the thermally-insulating material can be heated or melted in a short time. When thermally-insulating materials having different melting temperatures are desired to be mixed, it is preferred that these materials be individually heated by gas in advance. In such a case, gas heated to a desired temperature by the heat exchanging apparatus of the present invention can be used.

When radioactive contaminants are cooled with water in nuclear power plants, radiation-contaminated water is generated and the contaminated water causes a disposal problem. There is the idea of cooling the radioactive contaminants by air in order not to generate contaminated water. In that case, an apparatus for cooling a huge amount of air instantaneously at site is required. The heat exchanging apparatus of the present invention is advantageously applied for that purpose.

According to one or more embodiments of the present invention, in order to heat the heat exchanging apparatus, an electric heater or a high-temperature exhaust gas can be used as a high-temperature heat medium. In order to prevent burn injury when the heat exchanging apparatus has a high temperature, the heat exchanging apparatus is enclosed by a thermally-insulating member and housed in a case.

When the heat exchanging apparatus is desired to be cooled to a low temperature, the heat exchanging apparatus may be brought into contact with water serving as a low-temperature medium, or immersed in water.

According to one or more embodiments of the present invention, only heat can be exchanged with no contact between gas and gas, liquid and gas, or liquid and liquid.

Since the heat exchanging apparatuses are in back-to-back contact with each other, the volume of the heat exchanger is small and the heat-exchange efficiency is high. By selecting a material for the heat exchanging apparatus, a heat-exchanging method that can avoid such a problem as corrosion, wear, or toxicity, can be realized.

When this structure is adopted to indoor equipment and outdoor equipment of a cooling machine, the advantageous effect of reducing the respective sizes of the indoor equipment and the outdoor equipment can be achieved since this structure has a small volume unlike a large-volume pipe having fins.

According to one or more embodiments of the present invention, reusable gas having a high chemical potential can be extracted from meat, vegetables, or wood chips so that the gas can be reused as a fuel resource.

BRIEF DESCRIPTION OF THE DRAWINGS

FIG. 9 is a table of values of dimensional parameters of examples;

DETAILED DESCRIPTION

Figure 1:
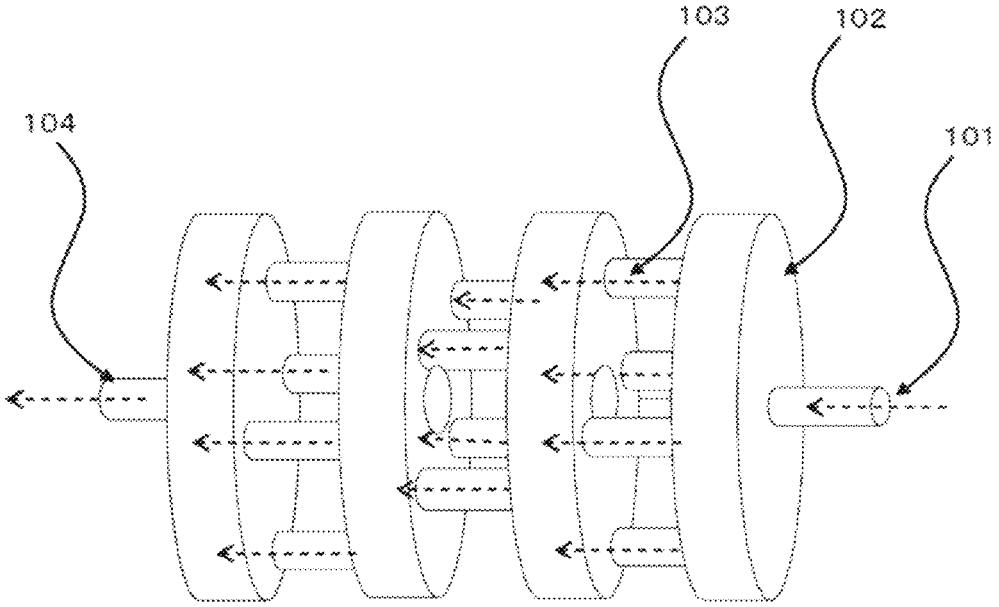
FIG. 1 Prior art
FIG. 1 is a schematic view of one example of conventional gas heating apparatuses (Re-Publication of PCT Patent Publication: WO 2006/030526)
Figure 2:
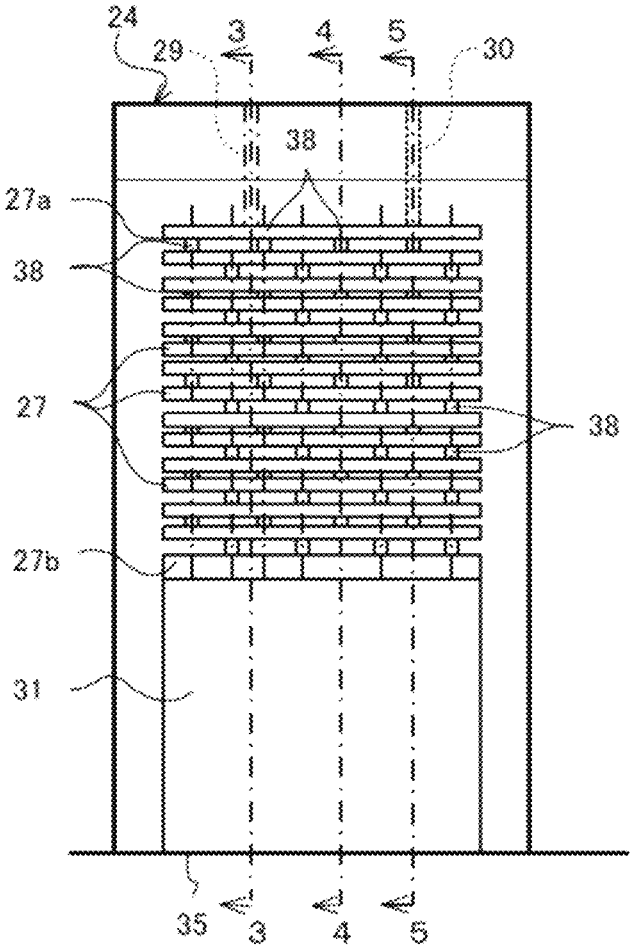
FIG. 2 Prior art
FIGS. 2 through 5 are schematic views of one example of conventional gas heating apparatuses (FIG. 5 of a gas heating apparatus described in Japanese Patent Application Laid-open Publication No. 2011-001591)
Figure 3:
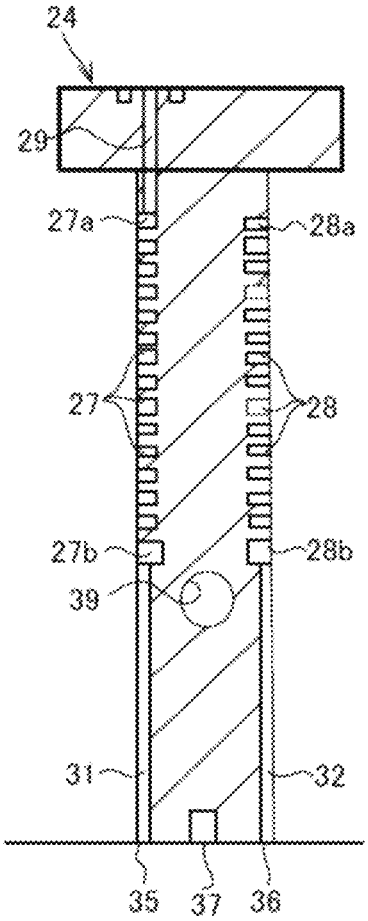
FIG. 3 Prior art
Figure 4:
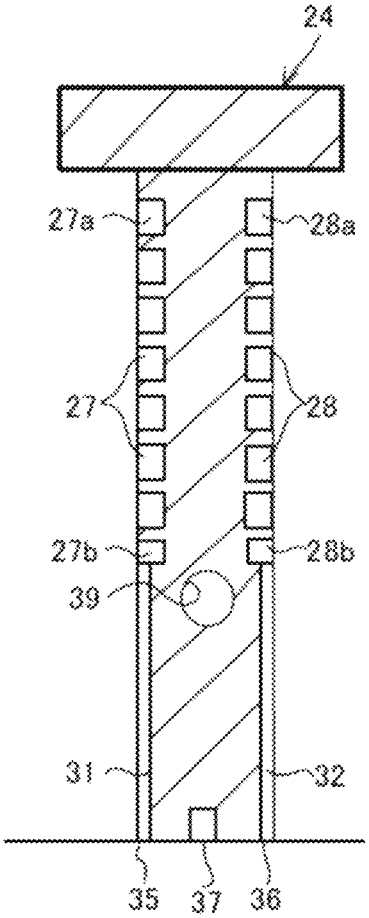
FIG. 4 Prior art
Figure 5:
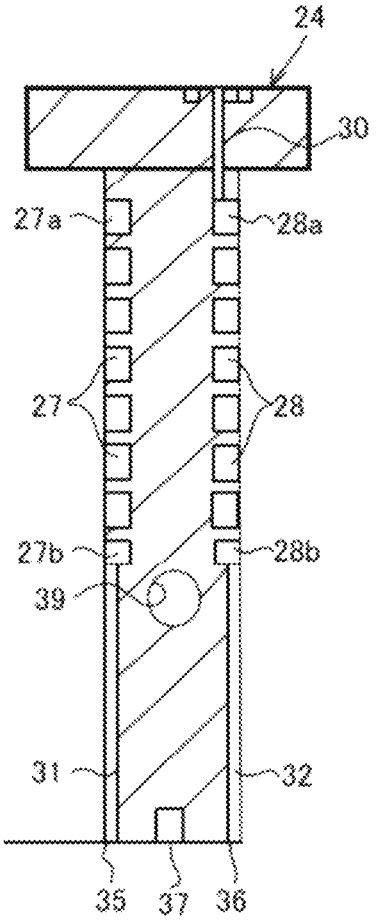
FIG. 5 Prior art
Figure 6:
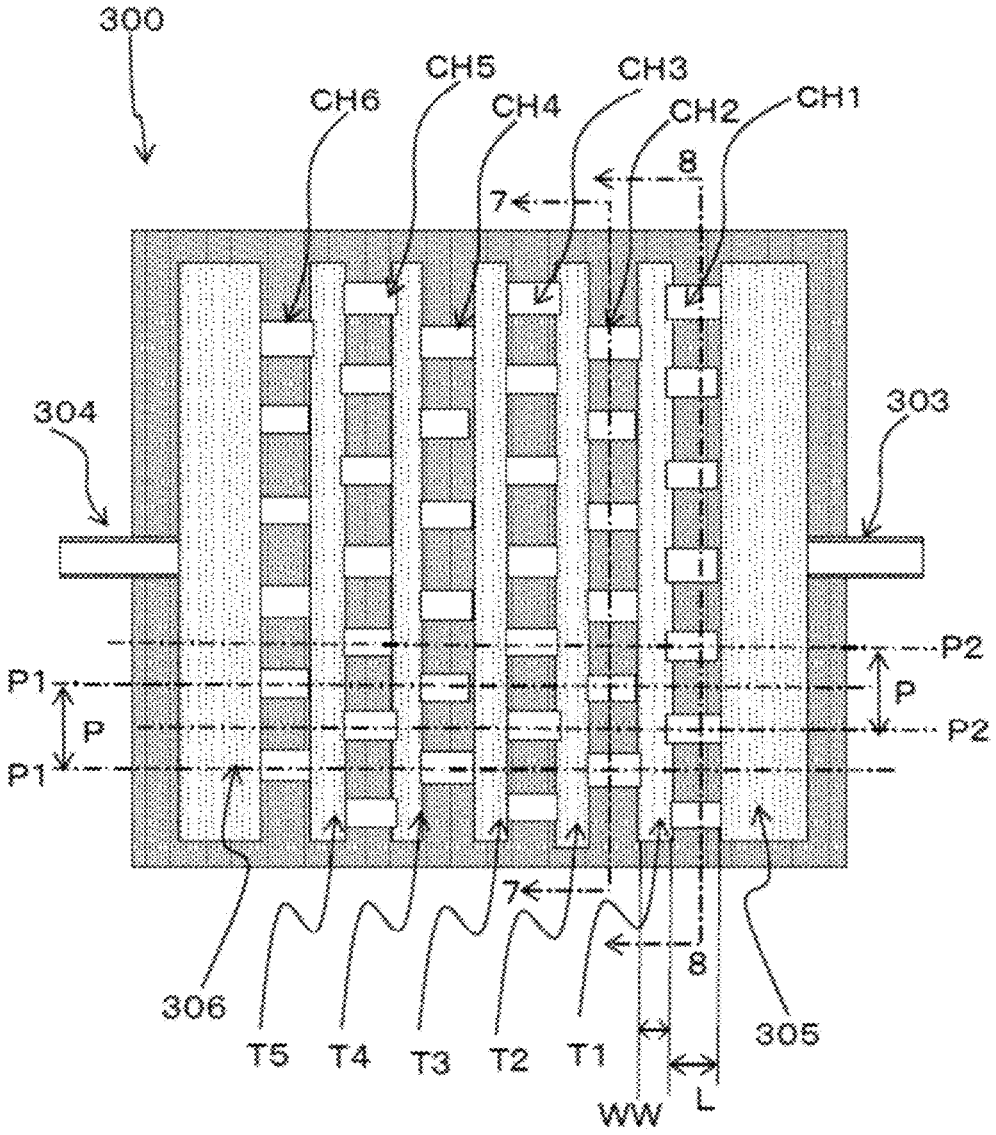
FIG. 6 is a plan view of a cross-section of a heat exchanging apparatus.
Figure 7:
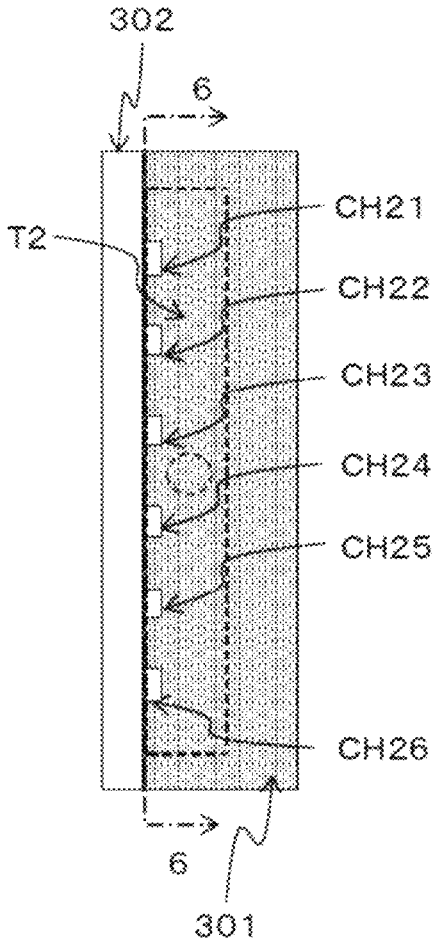
FIG. 7 is a cross-section along line 7-7 of heat exchanging apparatus of FIG. 6.
Figure 8:
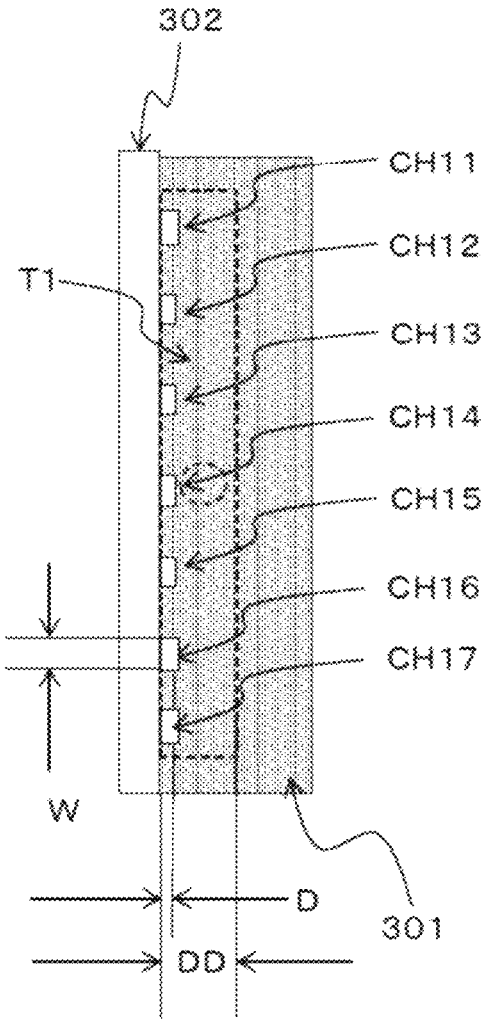
FIG. 8 is a cross-section along line 8-8 of the heat exchanging apparatus of FIG. 6.

In order to describe the above design guidelines, a basic part of a heat exchanger is illustrated in FIGS. 6 through 8. This structure has certain similarities to the prior art structure, as indicated in places below, but also differs at least in the relationships among the flow passages as fully described below.

Flow passages of grooves that are structures similar to those of Patent Literature 2 are formed in a base 301 on which the heat exchanging apparatus 300 is constructed. A sealing plate 302 seals the groove flow passages to form flow passages. The base 301 is heated or cooled, and fluid flows through the flow passages to exchange heat with the base 301.

Buffer tubs 305, 306 are provided at both ends of the flow passages in FIG. 6 as horizontal groove flow passages in which the fluid is collected, and a fluid inlet 303 is provided so as to be connected to the buffer tub 305, and a fluid outlet 304 is provided so as to be connected to the buffer tub 306.

Tubs T1, T2, T3, T4, T5 correspond to the flow passages of the horizontal grooves 27 or 28 in the patent literature 2.

The tubs T1 to T5 form flow passages and the tubs T1 to T5 are sometimes referred to as first flow passages in the following structural description. The width of each of the tubs T1 to T5 is denoted by WW, and the depth of each of the tubs T1 to T5 is denoted by DD.

Channels CH correspond to the flow passages of the longitudinal grooves 38 in the patent literature 2. Channel flow passages connected to the same tub flow passage are collectively referred to as channel row, and the channel rows are assigned with numbers in the order, like CH1, CH2, CH3, CH4, and CH5. The channels in the same channel row are also assigned with numbers, for example, the channels in the channel row CH2 are assigned with CH21, CH22, CH23, CH24, CH25, and CH26 (see FIG. 7).

In the following structural description, the channels forming the flow passages are sometimes referred to as second flow passages.

The pitch of channel arrangement in the same channel row is denoted by P. Channel central axes P1 and P2 of adjacent channel rows are arranged so as to be out of alignment by one half of the pitch. The width of the channel CH is denoted by W. The depth of the channel CH is denoted by D. The length of the channel is denoted by L.

As described above, fluid passes through the tubs that are first flow passages and the channels that are second flow passages.

The guidelines for dimensional design that causes efficient heat exchange in the prior art structure are explained below.

A first guideline is a relationship between the cross-sectional area of the tub T (denoted below by St) and the cross-sectional area of the channel CH (denoted below by Sc). Since the structure is such that the fluid leaving the channel CH flows in a diverging fashion in two directions, if simply 2Sc=St, no change in the speed of the flow occurs and no pool is formed. That is, 2Sc=St is considered to be a dimensional relationship in which flows of the same speed without turbulence are formed.

If St≤2Sc, that is, if the flow speed in the channel is slower than the flow speed in the tub, St≤2Sc is defined as a relationship in which either (i) the fluid does not impinge against the wall of the tub, or (ii) a relationship in which a laminar flow is generated.

When a laminar flow flowing along the tub wall without being disturbed is formed, the efficiency of heat exchange with the wall significantly lowers.

A relationship in which the fluid impinges against the wall is defined as 2Sc<St in the opposite meaning of the condition under which a laminar flow is formed.

A second guideline is a relationship between the length L of the channel CH and the width WW of the tub T.

In order for a flow that has gained a high flow speed in the channel CH to reach the wall of the tub T and impinge against the wall, the width WW of the tub T is desired to be at least shorter than the length L of the channel CH. When it is defined that a distance of transmission of the high flow speed of the flow that has left the channel CH to the wall corresponds to the length L of the channel CH, a design guideline that causes impingement is L>WW.

A third guideline is a positional relationship between the channels in the channel rows adjoining via the tub.

When the central axes P1 and P2 of the channels in the adjacent channel rows are coincident with each other, the fluid passing through the channel passes transversely through the in-between tub as a uniaxial laminar flow. That is, the fluid never impinges against the wall of the tub.

Even when the central axes P1 and P2 are not completely coincident with each other, as long as the channels in the adjacent channel rows partially overlap with each other, a flow that does not impinge against the tub wall is formed since the fluid flows preferentially into an easy-to-flow flow passage. Therefore, the channels in the adjacent channel rows must be arranged so as not to overlap with each other.

The overlapping portion is created when P≤2 W is satisfied if the channel pitch P is used for representation.

Therefore, in order to avoid causing the channels in the adjacent channel rows to overlap with each other, P>2 W needs to be satisfied.

The design guidelines to cause the fluid to impinge against the wall of the tub without forming a laminar flow have been described above. These guidelines are the present guidelines.

The present guidelines are summarized as follows:

2Sc<St (Sc, St are the cross-sectional areas of the channel CH and the tub T, respectively);

L>WW (L is the length of the channel CH, WW is the width of the tub T); and

P>2 W (P, W are the arrangement pitch and the width of the channel CH, respectively).

Though FIGS. 6 through 8 illustrates cutting the channels and the tubs in the surface of the base 301 to form the grooves, thereby manufacturing the prior art structure, the present guidelines are applicable to design regardless of the shapes of the channel and the tub constituting the prior art structure.

The channel may be not a groove but a hole. The shape of a cross-section of the tub may be rectangular, triangular, or elliptical.

The materials of the base 301 and the sealing plate 302 forming the prior art structure may be metal, graphite, ceramic, plastic, a composite material, or a combination of these.

The composite material may be a composite material of at least two or more of metal, carbon nanotube, graphene, carbon fiber, and plastic.

The material may be a plate, and the prior art structure may be manufactured by machining the plate as the base 301 by means of a die to shape the channels and the tubs in the base 301, and joining the sealing plate 302 to the base 301 by bonding.

When a peripheral material coming into contact with the heat exchanging apparatus 300 or the fluid has corrosive properties, the material surface of the heat exchanging apparatus 300 may be lined with resin, coated, or plated. The material surface may also be oxidized and protected with an oxide film.

Joining the base 301 and the sealing plate 302 to each other may be made by screwing. A rubber packing, a carbon packing, or another seal packing can also be used to join the base 301 and the sealing plate 302.

The above joining may also be joining performed by an adhesive.

The above fluid may be gas (air, for example) or liquid (water, for example).

Water is a special source material. Since water can be used as a source material of steam gas without specially preparing gas, water can be utilized as gas containing no oxygen gas.

High-temperature steam having a temperature of higher than 100° C. has a high ability of decomposing organic matter. If organic waste, such as meat, vegetables, wood chips, or plastics, is brought into contact with steam of approximately 1000° C., molecules thereof are cleaved or decomposed, and gas containing hydrogen, carbon, or oxygen is generated.

Even when meat is brought into contact with steam with a temperature lower than this temperature, for example, high-temperature steam of approximately 300° C., the strings of the meat can be changed so that the meat becomes tender and easy to chew. This is applicable to a safe barbecue using no fire.

The above gas having a high chemical potential that is extracted by bringing the above high-temperature steam and the gas containing waste or organic matter is reusable as an energy resource. Therefore, the heat exchanging apparatus performing this is an organic matter treatment apparatus.

The heat exchanging apparatus 300 is a single unit illustrated in a planar shape, but can be bent into a tube having a triangular or rectangular shape or other polygonal shapes. The heat exchanging apparatus 300 can take a cylindrical shape when being made from a plate having a circular tubular shape, not a planar shape.

The number, shapes, or arrangement positions of the fluid outlets 304 or the fluid inlets 303 can be freely designed. When a plurality of heat exchanging apparatuses 300 are connected, the plurality of heat exchanging apparatuses 300 can be connected in series by connecting the fluid inlet of an heat exchanging apparatus to the fluid outlet of another heat exchanging apparatus, or connected in parallel by connecting the fluid inlets of these heat exchanging apparatuses and connecting the fluid outlets of them.

Instead of changing the shape of the heat exchanging apparatus 300, a plurality of heat exchanging apparatuses 300 may be bonded to a surface of another tube or plate.

In order to heat fluid, a heater may be attached to the heat exchanging apparatus 300, or the heat exchanging apparatus 300 may be placed in a heated medium.

For example, it is known that it is effective to introduce air heated to high temperature in order to improve the combustion efficiency of a boiler. In order to achieve this object, it is preferred that the heat exchanging apparatus 300 be brought in contact with a combustion chamber or an exhaust piping of the boiler or be placed in the combustion chamber or the exhaust piping of the boiler to heat air so that the heated air can be introduced as heating air.

In order to cool the fluid, a coolant may be brought into contact with the heat exchanging apparatus 300, or the heat exchanging apparatus 300 may be placed in a low-temperature medium.

For example, high-temperature gas from a turbine or a combustion chamber can be efficiently cooled by causing the high-temperature gas to flow through the heat exchanging apparatus 300 as fluid and cooling this heat exchanging apparatus 300 in seawater.

In some cases, heat exchange between first gas and second gas is desired to be performed instantaneously. In order to achieve this object, it is preferred that a first heat exchanging apparatus 300 and a second heat exchanging apparatus 300 be jointed back to back via the sealing plate 302, and first gas be caused to flow through the first heat exchanging apparatus 300 and second gas be caused to flow through the second heat exchanging apparatus 300.

For example, when ammonia used in geothermal generation is desired to be cooled by air, high-temperature ammonia gas can be used as first gas, and air as second gas.

Design parameters of example 1 and example 2 are shown in FIG. 9. The values of the parameters in FIG. 9 satisfy the three design guidelines:

2Sc<St;

L>WW; and

P>2 W.

In the example 1, a heat exchanging apparatus was manufactured by machining a stainless steel base material by means of an end mill to form tubs and channels in the base material, and screwing a stainless plate to the base material. A rod-like electric heater was embedded in the base and fluid was heated.

In the example 2, a heat exchanging apparatus was manufacture by forming tubs and channels in a stainless cylinder surface by means of a lathe and an end mill and tightly fitting this cylinder into a cylindrical stainless pipe.

A hole was opened at a central axis and a rod-like heater was embedded in the hole so that fluid could be heated.

In both of the heat exchanging apparatuses, nitrogen gas was caused to flow as fluid, and the heat exchange efficiency was equal to or more than 80% on the basis of a relationship between the consumed power of the heater and the flow rate and temperature of the nitrogen gas heated and discharged. Since the structure caused the gas to impinge, the heat exchange efficiency became higher as the flow rate increased because in principle the heat exchange efficiency became higher as the flow rate increases.

Figure 10:
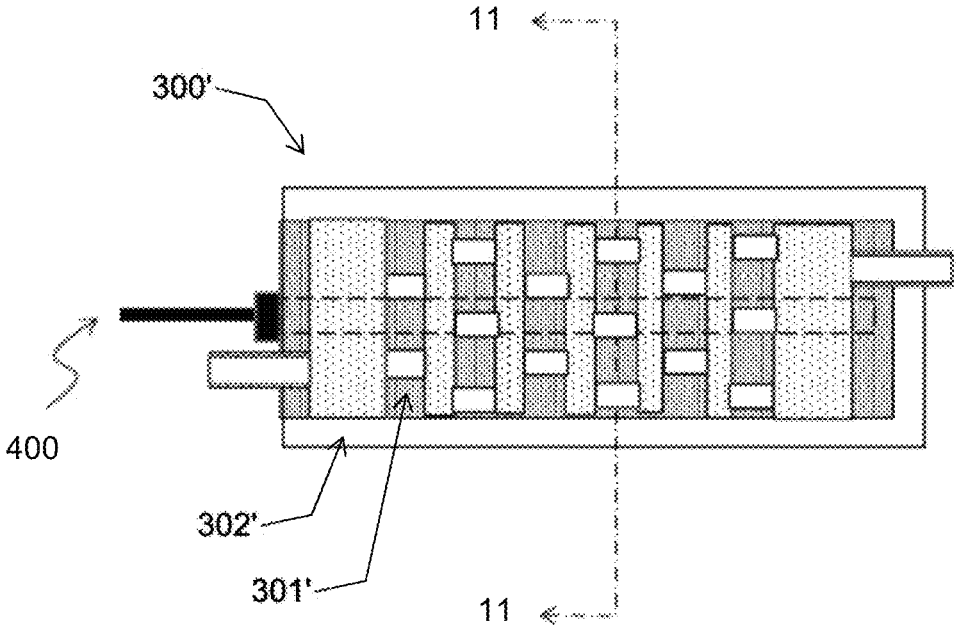
FIG. 10 is a plan view of a cross-section of a heat exchanging apparatus.
Figure 11:
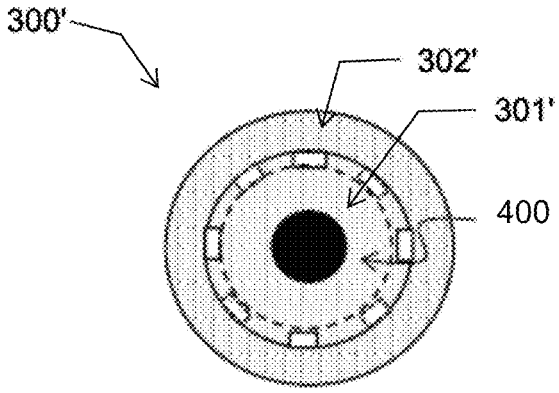
FIG. 11 is a cross-section along line 11-11 of the heat exchanging apparatus of FIG. 10.

FIG. 10 and FIG. 11 show a heat exchanging apparatus 300' having a cylindrical tube structure with base 301' and plate 302' into which a heater 400 is inserted.

Figure 12:
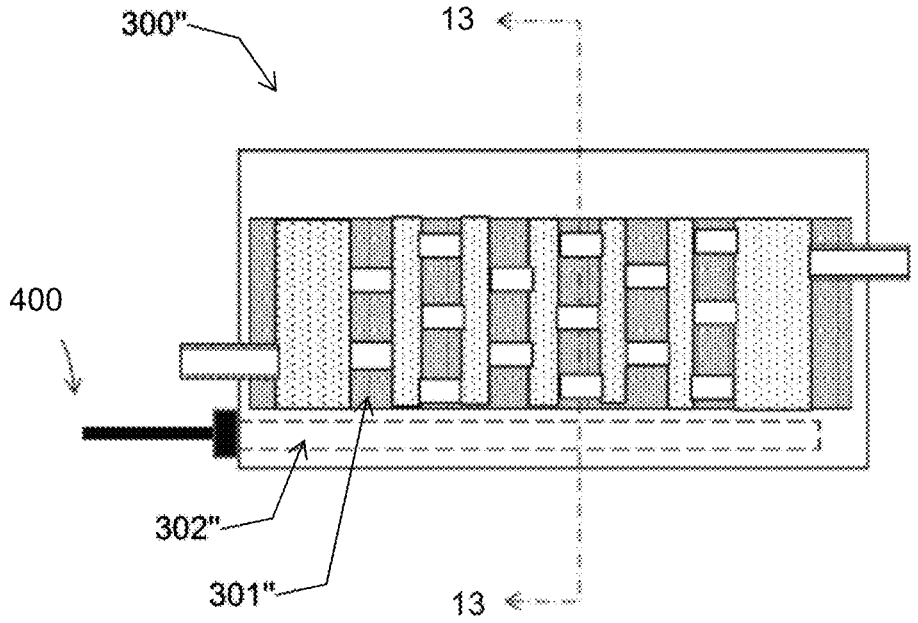
FIG. 12 is a plan view of a cross-section of a heat exchanging apparatus.
Figure 13:
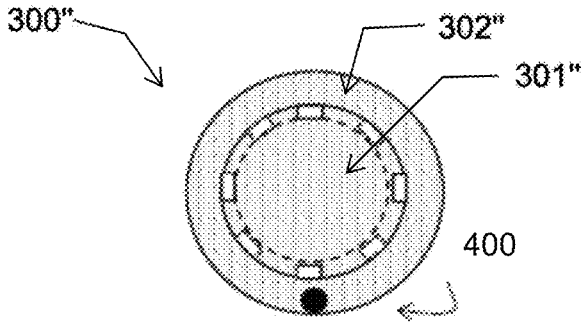
FIG. 13 is a cross-section along line 13-13 of the heat exchanging apparatus of FIG. 12.

FIG. 12 and FIG. 13 show a heat exchanging apparatus 300" having a columnar tube structure with base 301" and plate 302" into which a heater 400 is inserted.

Figure 14:
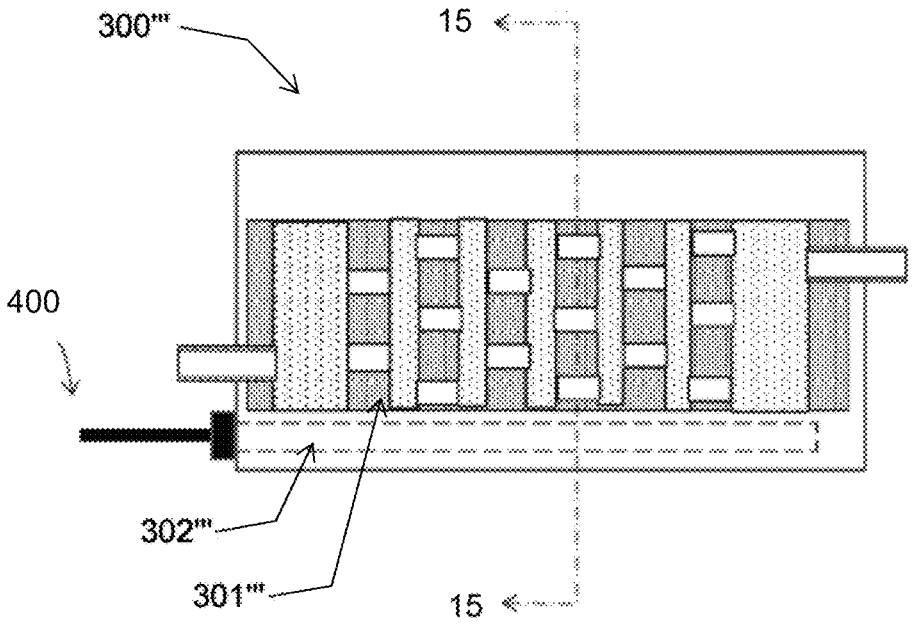
FIG. 14 is a plan view of a cross-section of a heat exchanging apparatus.
Figure 15:
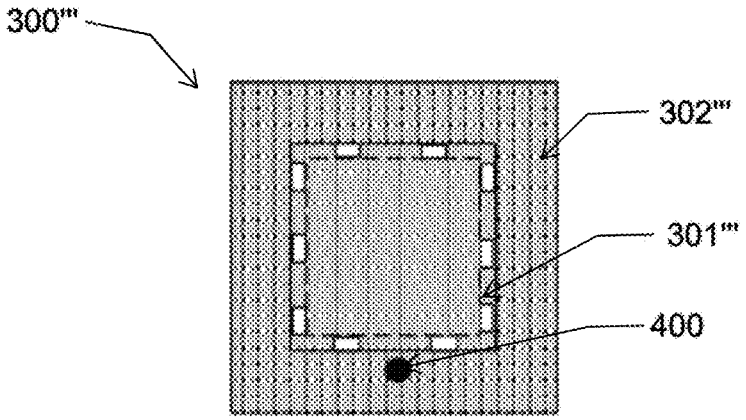
FIG. 15 is a cross-section along line 15-15 of the heat exchanging apparatus of FIG. 14.

FIG. 14 and FIG. 15 show a heat exchanging apparatus 300'" having a prismatic tube structure with base 301'" and plate 302'" into which a heater 400 is inserted.

Figure 16:
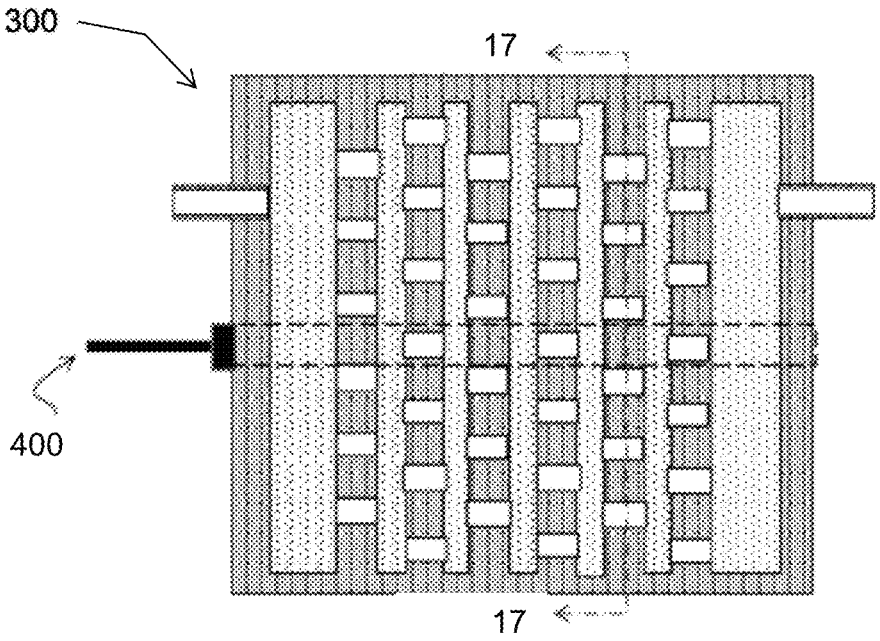
FIG. 16 is a plan view of a cross-section of a heat exchanging apparatus.
Figure 17:
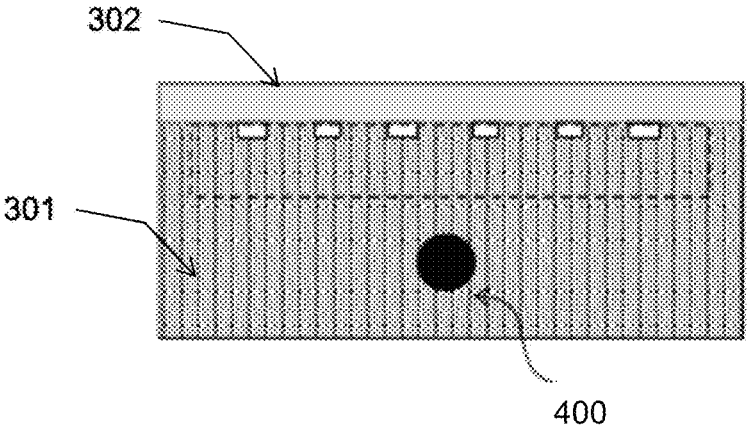
FIG. 17 is a cross-section along line 17-17 of the heat exchanging apparatus of FIG. 16.

FIG. 16 and FIG. 17 show a heat exchanging apparatus 300 that heats a fluid by having a heater 400 mounted therein.

Figure 18:
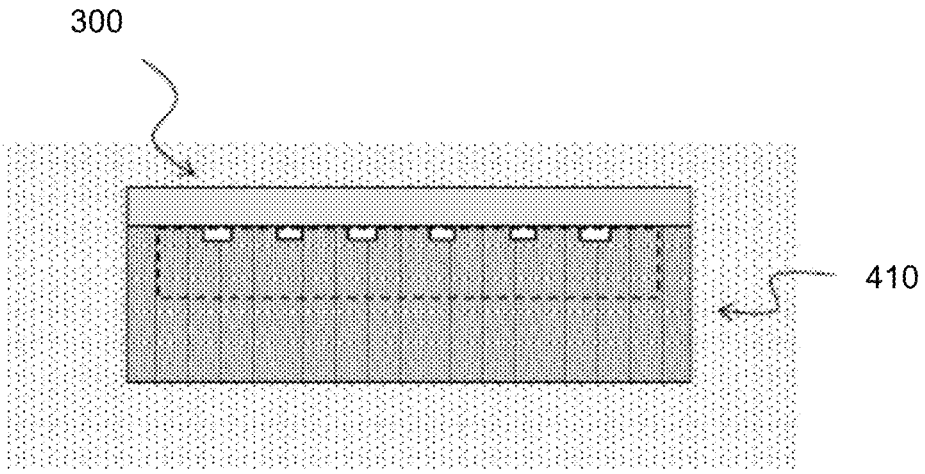
FIG. 18 is a cross-section view of a heat exchanging apparatus placed in a heating medium.

FIG. 18 shows a heat exchanging apparatus 300 that heats a fluid by being placed in a heated high-temperature medium 410.

Figure 19:
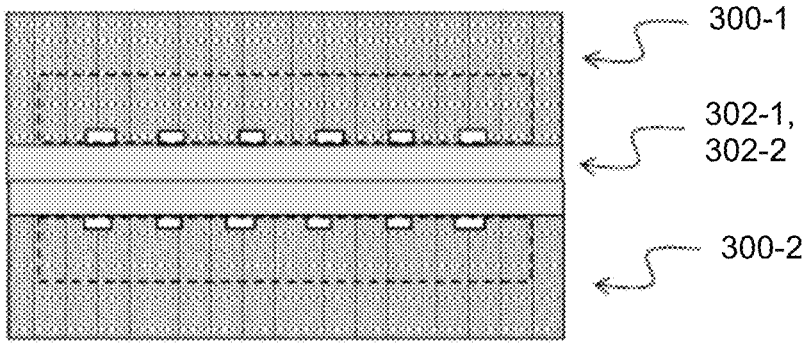
FIG. 19 is a cross-section view of two heat exchanging apparatuses joined together.

FIG. 19 shows two heat exchanging apparatuses 300-1, 300-2 joined together for first fluid and second fluids to flow therethrough, respectively.

The present invention inexpensively provides small and light parts for producing a huge amount of gas or liquid heated to high temperature. The field of application of the present invention can be drying of a printed material, a downsized heating-cooling combination appliance, heat exchange in a heating and cooling apparatus for a material containing a toxic substance or a radioactive substance or for a corrosive material, high-speed generation of high-temperature steam, a heating vaporizing apparatus for waste, melting of industrial waste plastic, or the like.

The present invention is also advantageously applied to the technique of forming a solar battery or a flat panel display (FPD) on a large substrate such as a glass substrate inexpensively by heating film deposition.

EXPLANATION OF REFERENCE NUMERALS

101 gas inlet
102 hollow disc
103 pipe
104 gas outlet
300 heat exchanging apparatus
301 base
302 sealed plate
303 fluid inlet
304 fluid outlet
305, 306 buffer tub
CH1, CH2, CH3, CH4, CH5, CH6 channel row
T1, T2, T3, T4, T5 tub
W width of channel
WW width of tub
D depth of channel
DD depth of tub
L length of channel
P pitch of channel arrangement
Sc sectional area of channel
St sectional area of tub

What is claimed is:

1. A heat exchanging apparatus in which a base in which a flow passage for fluid is formed is jointed to a sealing plate sealing the flow passage to form an airtight flow passage, the flow passage comprising:

first flow passages opened outside in a surface of the base, elongated in one direction, and formed in a plurality of stages in one direction of the base at required intervals; and a plurality of second flow passages perpendicular to the first flow passages and connecting adjacent flow passages of the first flow passages in a communicating manner, in a structure of the heat exchanging apparatus where a flow passage is formed such that fluid introduced into a first flow passage of the first flow passages located at one end to pass through the first flow passage located at one end and the second flow passages and reach a first flow passage of the first flow passages located at the other end, and fluid introduced into the flow passage impinges perpendicularly against walls of the first flow passages to perform heat exchange, and the fluid is discharged from a fluid outlet hole located at the other end of the flow passage, wherein a flow speed in the second flow passages is higher than a flow speed in the first flow passages, wherein two or more of the following conditions are satisfied:

a cross-sectional area St of the first flow passage is twice as large as a cross-sectional area Sc of the second flow passage;

a length L of the second flow passage is longer than a width WW of the first flow passage; and an arrangement pitch of the second flow passage is twice as large as a width of the second flow passage.

2. The heat exchanging apparatus according to claim 1, wherein the base in which the flow passage is formed is either one of:

a plate; and a tube having a cylindrical, columnar, or prismatic shape.

3. The heat exchanging apparatus according to claim 1, wherein the base and the sealing plate are composed of at least one of:

metal;
graphite;
ceramic;
plastic; and
a composite material.

4. The heat exchanging apparatus according to claim 3, wherein the base and the sealing plate are composed of the composite material, and wherein the composite material is a composite material of two or more of:

metal;
metal fiber;
carbon nanotube;
graphene;
carbon fiber; and
plastic.

5. The heat exchanging apparatus according to claim 1, wherein the structure is manufactured by machining the base by means of a die to shape the first and second flow passages, and joining the sealing plate to the base.

6. The heat exchanging apparatus according to claim 1, wherein a material surface of the heat exchanging apparatus is:

lined with resin;
coated;
plated; or
protected with an oxide film.

7. The heat exchanging apparatus according to claim 1, wherein the fluid is gas or liquid.

8. The heat exchanging apparatus according to claim 1, wherein the fluid is steam having a temperature exceeding 100° C.

9. The heat exchanging apparatus according to claim 1, wherein the heat exchanging apparatus heats the fluid by:

being mounted with a heater; or being placed in a heated high-temperature medium.

10. The heat exchanging apparatus according to claim 1, wherein the heat exchanging apparatus cools the fluid by:

being brought into contact with a low-temperature medium; or being placed in a low-temperature medium.

11. A heat exchanging apparatus, wherein two heat exchanging apparatuses according to claim 1 are joined together, and first fluid and second fluid are caused to flow through the two heat exchanging apparatuses, respectively.

* * * * *